US006085949A

United States Patent [19]

Zimny et al.

[11] Patent Number: 6,085,949

[45] Date of Patent: Jul. 11, 2000

[54] CONTAINER WITH MOLDED-IN DIRECTIONAL POUR GUIDE

[75] Inventors: Irvin C. Zimny; Patrick M. Maloney, both of Glen Ellyn, Ill.

[73] Assignee: Liquid Container L.P., West Chicago, Ill.

[21] Appl. No.: 09/072,176

[22] Filed: May 5, 1998

[51] Int. Cl.[7] ..... B65D 5/72

[52] U.S. Cl. ..... 222/572; 222/575; 222/564

[58] Field of Search ..... 222/566, 567, 222/575, 572, 420, 421, 564, 547; 215/41, 42, 44

[56] References Cited

U.S. PATENT DOCUMENTS

| | | | |
|---|---|---|---|
| 763,973 | 6/1904 | Flynn . | |
| 1,349,591 | 8/1920 | Tiefenbrun . | |
| 1,718,897 | 6/1929 | Dunbar et al. . | |
| 1,820,406 | 8/1931 | Thompson . | |
| 1,903,300 | 4/1933 | Rollason . | |
| 2,069,089 | 6/1937 | Goldman et al. . | |
| 2,431,059 | 11/1947 | Marshall . | |
| 2,448,099 | 8/1948 | Kassovic . | |
| 2,543,470 | 2/1951 | Ryan . | |
| 2,640,237 | 6/1953 | Bryant . | |
| 2,646,193 | 6/1953 | Best . | |
| 2,687,628 | 8/1954 | Cunningham . | |
| 2,739,740 | 3/1956 | Livingstone . | |
| 2,945,612 | 7/1960 | Weiffenbach | 222/570 |
| 2,982,450 | 5/1961 | Whitton, Jr. . | |
| 3,091,373 | 5/1963 | Kirschenbaum | 222/420 |
| 3,126,125 | 3/1964 | Eggers . | |
| 3,143,257 | 8/1964 | Mumford . | |
| 3,186,606 | 6/1965 | Williams . | |
| 3,240,348 | 3/1966 | Serio | 222/570 |
| 3,309,000 | 3/1967 | Haverstick . | |
| 3,311,275 | 3/1967 | Gibson | 222/564 |
| 3,317,418 | 5/1967 | Mullen . | |
| 3,319,842 | 5/1967 | Miller | 222/479 |
| 3,323,693 | 6/1967 | Miller . | |
| 3,330,450 | 7/1967 | Clare | 222/567 |
| 3,374,360 | 3/1968 | Brown . | |
| 3,434,635 | 3/1969 | Mason, Jr. . | |
| 3,463,366 | 8/1969 | Spencer . | |
| 3,800,999 | 4/1974 | Serritella . | |
| 3,811,606 | 5/1974 | Higgins . | |
| 3,820,692 | 6/1974 | Swett et al. | 222/547 |
| 3,873,001 | 3/1975 | Shulman . | |
| 4,235,348 | 11/1980 | Watson . | |
| 4,322,014 | 3/1982 | Philip . | |
| 4,331,255 | 5/1982 | Fournier . | |
| 4,433,800 | 2/1984 | Owens | 222/547 |
| 4,509,665 | 4/1985 | Goodall . | |
| 4,637,530 | 1/1987 | Jiang . | |
| 4,640,855 | 2/1987 | St. Clair . | |
| 4,706,829 | 11/1987 | Li . | |
| 4,736,874 | 4/1988 | Durant . | |
| 4,830,234 | 5/1989 | Odet . | |
| 4,850,501 | 7/1989 | Shield . | |
| 4,890,768 | 1/1990 | Robinson . | |
| 4,957,224 | 9/1990 | Kessler et al. . | |
| 4,981,239 | 1/1991 | Cappel et al. . | |
| 5,012,960 | 5/1991 | Arnold . | |
| 5,078,288 | 1/1992 | Fuchs . | |

(List continued on next page.)

*Primary Examiner*—Kevin Shaver
*Assistant Examiner*—Melvin A. Cartagena
*Attorney, Agent, or Firm*—Hill & Simpson

[57] ABSTRACT

A container for holding and pouring semi-viscous or viscous liquids is disclosed and is particularly useful for holding and pouring condiments such as ketchup, mayonnaise, mustard, relish or semi-viscous liquids such as salad dressing. The container includes an integrally molded body having a neck finish defining a generally cylindrical opening and being adapted to secure a lid to the container. At least one shaped pour guide is formed by the body below the neck finish for controlling and directing the flow of liquids out of the container in at least one selectable direction. In an embodiment, the container includes a plurality of shaped pour guides formed by the neck of the container and being spaced equidistantly about a circumference of the neck finish and opening of the container.

10 Claims, 1 Drawing Sheet

U.S. PATENT DOCUMENTS 5,111,976 5/1992 Ban .
5,160,067 11/1992 Luber .
5,181,630 1/1993 McNally .
5,207,356 5/1993 Krall .
5,228,596 7/1993 McNally .
5,246,149 9/1993 Broitzman .
5,289,953 3/1994 McMillan, III et al. .
5,340,000 8/1994 Ring .
5,392,948 2/1995 McEntee .
5,443,184 8/1995 Broitzman .
5,573,139 11/1996 Yeh .
5,626,258 5/1997 Maiorino .
5,649,650 7/1997 Klauke .

FIG. 1
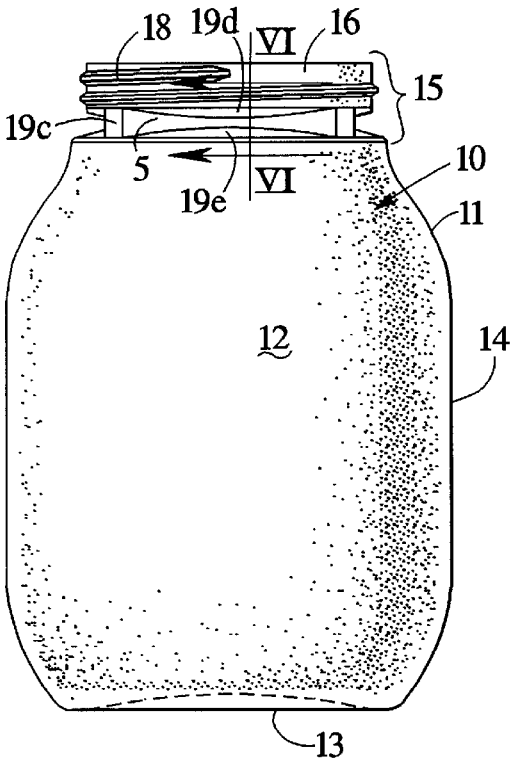
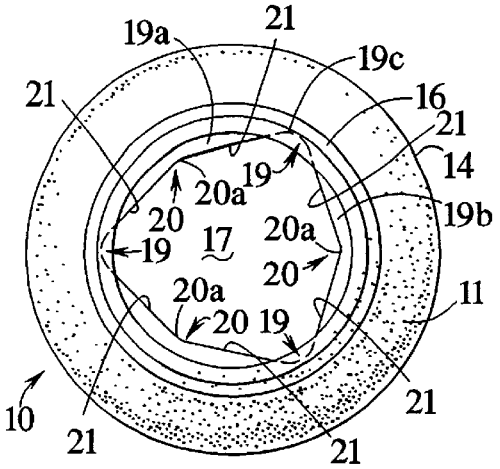
FIG. 2
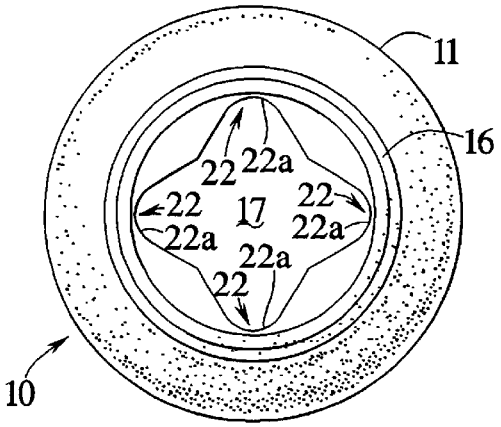
FIG. 3
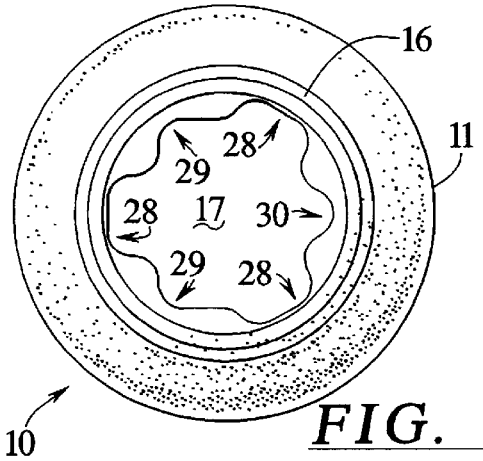
FIG. 5
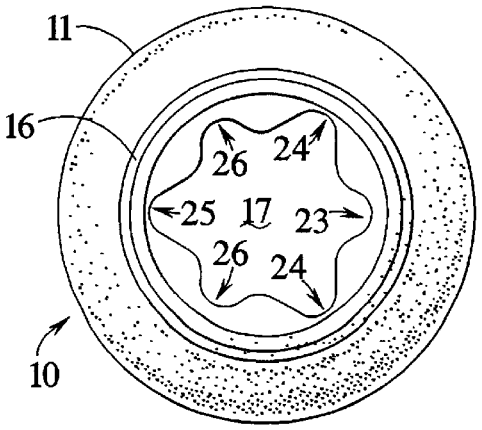
FIG. 4
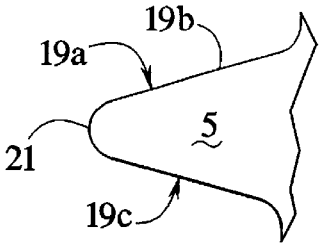
FIG. 6

CONTAINER WITH MOLDED-IN DIRECTIONAL POUR GUIDE

BACKGROUND OF THE INVENTION

This invention relates to containers for holding foodstuffs and the like and more particularly to a container having a molded-in directional pouring feature for controlling the outflow of the contents from the container.

Many varieties of containers are currently known for holding packaged foodstuffs for sale at the retail or commercial level. Examples of such well-known containers include aluminum cans or injection-molded plastic containers for beverages and glass or plastic jars for foodstuffs such as condiments. While such containers have been known for decades, such containers are continually being improved by reducing the container material to reduce cost and waste and by making the container more convenient for use by the consumer. Both of these factors, reduction in cost and waste as well as increasing convenience, can help facilitate sale of the product held by the container.

Many of the containers on the market today are inconvenient or clumsy to use. This is particularly true with regard to highly viscous foodstuffs such as ketchup, mayonnaise, relish and mustard. For example, the difficulty in pouring ketchup from a glass ketchup bottle is well-known in that the ketchup is often slow to initially pour and then tends to pour too rapidly or glop out of the bottle once pouring starts. To overcome this problem, ketchup now commonly comes in a plastic squeeze bottle that is more convenient for customer use. However, use of such plastic squeeze bottles is not practical for commercial size containers for foodstuffs that often come in containers of 64 ounces or greater for use at restaurants, cafeterias, and other commercial or institutional applications.

Many containers of relatively larger size are known to use pour guides to make use of the container more convenient. However, it is believed that such pour guides are impractical for use with large commercial size wide-mouth containers for condiments. As one example, U.S. Pat. Nos. 5,626,258 and 5,012,960 disclose configured lids that can be attached to a wide-mouth paint can for providing a controlled flow guide. However, use of an auxiliary component requires an additional part for sale to customer, requires effort by the customer to use, and results in additional manufacturing and sale costs as well as additional waste.

Newer liquid laundry detergent containers are known to have special pouring spouts. Typically, the container includes a narrow spout that projects upwardly and outwardly a considerable distance beyond the threaded neck of the container for directing the pour of fluid so that the fluid does not come into contact with the threaded neck and so that fluid will self-drain back into the container. Examples of such self-draining pouring spouts can be found in U.S. Pat. Nos. 5,207,356 and 5,078,288. However, such self-draining containers are expensive to make and virtually preclude stacking the containers one on top of another.

Other containers have been proposed for directing the control of the outflow from a wide-mouth opening container by including a highly configured mouth such as shown in U.S. Pat. Nos. 5,443,184, 5,392,948, and 5,246,149. However, the unique and complex shaping of the openings of these containers results in the containers being permanently opened and precludes the sealing of the container, such as would be required for perishable foodstuffs.

SUMMARY OF THE INVENTION

In view of the foregoing, an important aspect of this invention lies in providing an integrally molded container for holding and pouring viscous and semi-viscous liquids that includes a molded-in directional pour guide or guide means for controlling and directing the flow of liquid out of the container in at least one selectable direction. The container is preferably a larger container having a capacity of about 32 to 640 ounces and including a generally cylindrical opening having a diameter of about 1 to 5 inches, which is particularly suitable for holding condiments such as ketchup, mayonnaise, relish or mustard. The directional pour guide of the inventive container advantageously makes it easier for users to handle and dispense the product contained in the container, and increasing the convenience of using the container can increase the desirability of purchasing that product.

In an embodiment, the container comprises an integrally molded body defining an interior chamber and having a bottom wall, a side wall and a neck. A neck finish is formed by the neck to accept a closure and defines a generally cylindrical opening to the interior chamber. The neck finish is adapted to secure a lid to the container in order to seal the chamber so that the container can hold perishable foodstuffs. At least one directional pour guide or guide means is formed by the body below the neck finish for controlling and directing the flow of viscous or semi-viscous liquids out of the container in at least one selectable direction.

Importantly, the directional pour guide or guide means is integrally molded in the body below the neck finish so that the configuration of the neck finish can remain a constant for accepting a standard or conventional lid. By using a segmented mold, the segment of the mold for the pour guide can be easily replaced or changed so that any desired or particular configuration of the directional pour guide or guide means can be easily integrally molded into the container below the neck finish.

In an embodiment, the directional pour guide takes the form of at least one shaped or profiled pour guide formed by the body below the neck finish and including first and second projections extending radially inwardly beyond the neck finish and defining a profiled shape therebetween. This profiled shape is preferably positioned generally axially under the neck finish. The first and second projections are formed by the neck of the container and extend generally transverse to the body and beyond the neck finish into the opening. The projections may also advantageously include top and bottom faces with the bottom face extending generally transverse to the body to act as a baffle for retaining fluid in the container and directing and controlling the flow of fluid toward the profiled shape for dispensing from the container. The container may include a plurality of such shaped pour guides formed by the neck and spaced about a circumference of the neck finish.

In one specific embodiment, the container includes a first set of three shaped pour guides having three equidistantly spaced profiled shapes positioned generally axially under the neck finish. The container also includes a second set of three shaped pour guides having three equidistantly spaced profiled shapes being generally positioned radially inward beyond the neck finish. Each of the shaped pour guides preferably has an included angle leading to the profiled shape of approximately 90°. In an embodiment, the angle of each of the first set of shaped pour guides (which each has the profiled shape positioned generally axially under the neck finish) preferably has an angle less than the angle of each of the second set of shaped pour guides (which each has an inwardly spaced profiled shape). The first set of profiled shapes can be advantageously used to control and direct the flow of fluid from the container when it is desired to pour the contents slowly and in a very specific direction, such as into the mouth of a smaller container for use by customers at a restaurant table. In contrast, the second set of pour guides (having a wider angle and being positioned inwardly) can be used to pour contents from the container more rapidly and in a general direction, such as into a large mixing vat for use in a recipe for restaurant or cafeteria-style preparation of large quantities of food.

In an embodiment, the projections that define each of the shaped pour guides have an interior edge that extends between the adjacent ones of the profiled shapes of each of the shaped pour guides. Linear edges or edges formed with large radiuses have projections that are able to perform their function of controlling and guiding the flow of fluid while limiting the restriction of the opening of the container. This is important in some applications where users may use a spoon or other scooping device to scoop contents out of the large container or to scrape out residual contents of the container and to avoid waste. The depth and shape of the edges of the pour guide can vary dependent upon the viscosity of the contents.

In alternate embodiments, the plurality of shaped pour guides around the circumference of the neck finish are varied in their position, number and specific profile. For example, four equidistantly spaced pour guides can be provided. Additionally, six or more pour guides can be provided in a plurality of different configurations, such as having different width profiled shapes, radii, or other geometrical patterns depending upon the application of which the container is intended.

Other features, objects and advantages will become apparent from the following description and drawings.

DESCRIPTION OF THE DRAWINGS

FIG. 1 is a side-elevational view of a container including a molded-in directional pouring feature of the present invention.

FIG. 2 is a top view of one embodiment of the container including a molded-in pouring feature of the present invention.

FIG. 3 is a top view of an alternate embodiment of the container including a molded-in pouring feature of the present invention.

FIG. 4 is a top view of an alternate embodiment of the container including a molded-in pouring feature of the present invention.

FIG. 5 is a top view of an alternate embodiment of the container including a molded-in pouring feature of the present invention.

FIG. 6 is a side-cross sectional view taken along the line 6—6 of FIG. 1.

DESCRIPTION OF THE PREFERRED EMBODIMENTS

Referring to FIGS. 1 through 5, the numeral 10 generally designates one embodiment of the container including a molded-in directional pouring feature of the present invention. The container 10 is formed from a integrally-molded body 11 that defines an interior chamber 12 and includes a bottom wall 13, a side wall 14 and a neck 15. The body 11 is generally shown as forming a cylindrical body with rounded edges and is particularly intended for use for holding large quantities of condiments such as ketchup, mayonnaise, relish or mustard. However, it will be understood that the particular configuration of the body 11 may vary considerably depending upon the application for which the container 10 is intended.

The neck 15 includes an axial neck finish 16 that defines a generally cylindrical opening 17 to the chamber 12. The mouth 17 preferably has a diameter of about 1 to 5 inches for permitting large amounts of material to be poured from the container for commercial applications and also to permit a spoon or other scooping device to be inserted into the container. The wide-mouth opening is particularly advantageous for use with large containers for commercial applications in that the contents can be poured into smaller containers for subsequent use or can be ladled out with a spoon or other scooping device in large quantities quickly. The wide-mouth opening also permits the user to scrape out residual contents in the container so that none of the contents is wasted. Preferably, the mouth 17 leads to a chamber 12 that is relatively large in size and falls within the range of about 32 to 640 ounces.

The neck finish 16 of neck 15 comprises a neck finish having a circular thread or snap bead 18 for securing a lid (not shown) to the container. The thread or snap bead 18 is provided so that a lid can be used to seal chamber 12 and to prevent spoilage of the contents therein.

Guide means are formed by the body 11 below neck finish 16 for providing a molded-in directional pouring feature for the container. The guide means is integrally molded with the remainder of the body 11 so that no additional or auxiliary components are necessary. The body 11 is preferably integrally molded in a segmented injection mold. The use of a segmented mold permits a separate and changeable segment to be used for forming the guide means below the neck finish in the neck 15 or the side wall 14. In either event, by positioning the segment mold for the guide means below the neck finish 16, the guide means can be varied without affecting the configuration of the neck finish 16, which advantageously remains a constant for permitting a uniform or standard lid to be used with the container.

One preferred embodiment of the guide means is exemplified by the container 10 shown in FIGS. 1, 2 and 6. In that embodiment, the guide means includes at least one V-shaped pour guide 19 formed by the body 11 (specifically the neck 15) below neck finish 16. The shaped pour guide 19 includes first and second projections 19*a* and 19*b* that extend radially inwardly beyond neck finish 16 into the opening 17 and define a profiled shape 19*c* therebetween. The profiled shape 19*c* controls and directs the flow of contents out of the container through the opening 17. Preferably, the profiled shape 19*c* is positioned generally axially under the neck finish 16, although the profiled shape 19*c* need not be directly below neck finish 16. In fact, as shown in FIG. 2, the neck finish 16 may include a slight lip 16*a* that slightly overlaps the profiled shape 19*c*. In any event, it is believed that the profiled shape 19*c* may be suitably positioned below the neck finish 16 within a transverse tolerance of about 0 to 2.0 inches.

A cross section of one of the first and second projections, namely projection 19*a*, is shown in FIG. 6 and includes a top and bottom surface 19*d* and 19*e*. While somewhat angled, the top and bottom surfaces 19*d* and 19*e* extend generally transverse to body 11 and radially beyond neck finish 16 into the opening 17. In use, the bottom surfaces 19*e* of the projections 19*a* and 19*b* act as a baffle to control and meter the flow of contents out of the chamber 12 and to direct the contents through the profiled shape 19*c*. By selectively rotating and then tipping the bottle, the user can use the guide means or V-shaped pour guide 19 to control and direct the amount and direction of the flow of viscous liquid out of the container in a selectable direction. Use of the pour guide 19 is particularly advantageous for use with viscous condiments such as ketchup, mayonnaise, relish, mustard or semi-viscous products because it permits the user to carefully control the amount of material that flows through the pour guide and also prevents glopping. In addition, the pour means or pour guide 19 serves to funnel or direct the flow of the material in a specified direction for select application, such as into a smaller individual size container for subsequent use or onto food.

As shown most clearly in FIG. 1 and FIG. 6, each of the projections 19*a* and 19*b* has a U-shaped cross section defining a hollow U-shaped space S between the top and bottom surfaces 19*d* and 19*e* on the exterior surface of the container 10. The U-shaped hollow configuration of the projections is advantageous from a manufacturing standpoint since it may be easily formed by using a specially configured segment mold to simply project into the neck to define the projections 19*a* and 19*c* as well as the profiled shapes 19*c* of each of the directional pour guides.

As shown in FIG. 2, the body 11 preferably defines a plurality of such V-shaped pour guides 19 spaced equidistantly about a circumference of the neck finish 16 and below the neck finish 16. The plurality of pour guides 19 are provided so that the user can easily select the direction for pouring material from the container without needing to unduly rotate the container. In FIG. 2, the container 10 is shown including a first set of three shaped pour guides 19 that have profiled shapes 19*c* that are positioned generally axially under the neck finish 16. The container 10 also includes a second set of three pour guides 20 that are equidistantly spaced about a circumference of the neck finish 16. However, the profiled shapes 20*a* of the second set of shaped pour guides 20 are positioned radially inwardly from the neck finish 16 for a different purpose than profiled shapes 19*c* as described in more detail hereinafter.

Each of the shaped pour guides 19 and 20 define an angle leading to the respective profiled shape 19*c* or 20*a*. The angle can be greater than 90° for both of the shaped pour guides 19 and 20. In any event, the angle of the outwardly positioned pour guides 19 is preferably less than the angle of the inner pour guides 20 to provide for different pouring characteristics. In an embodiment, the included angle of the shaped pour guides 19 can range from 15° to 100° and the included angle of the inner pour guides 20 can range from 90° to 160°. The pour guides can also be formed by profiled shapes other than angles. In use, the pour guides 19 provide for a slower more controlled flow of contents out of the container such as pouring the contents into individual containers for subsequent use by consumers such as at a restaurant table. In contrast, the wider angled inner shaped pour guides 20 provides for a much more rapid flow in a general direction, such as for disbursement into a large vat for preparing large quantities of food such as in a restaurant or cafeteria.

As shown in FIGS. 1, 2 and 6, each of the projections of each of the pour guides 19 and 20 has a substantially linear edge 21 extending between the adjacent respective profiled shapes 19*c* and 20*a*. By using an edge shape which limits the intrusion into the opening, the projections are sufficient to accomplish their purpose of controlling and directing the flow of fluid out of the container through the profiled shape while still not unnecessarily restricting the size of the opening 17. This is important because it permits a user to use a spoon or other scooping device to ladle or scoop out contents of the container when desired. Also, in view of the fact that the containers may be used in large commercial applications, a wide-mouth opening can be used to permit the user to scrape out residual content of the container (which may be significant) so that none of the contents is wasted.

While the embodiment shown in FIGS. 1, 2 and 6 is a preferred embodiment, the exact configuration of the guide means may still be varied considerably within the scope of this invention depending upon the particular application for which the container 10 is intended. Examples of alternate configurations are shown in FIGS. 3–5.

Referring to FIG. 3, the container 10 includes a plurality of V-shaped pour guides 22 that are spaced equidistantly about a circumference of the neck finish 16. The V-shaped pour guides 22 each include a profiled shape 22*a* positioned generally axially under the neck finish 16, although the profiled shapes may be positioned slightly inward within a tolerance of about 0 to 2 inches from the neck finish 16. The shaped pour guides 22 are substantially similar to V-shaped pour guides 19 except that a profiled shape 22*a* is slightly more rounded and the angle leading to the profiled shape is slightly narrower and falls within a range of about 15° to 90°. This particular configuration may be more useful or suitable for use with less viscous substances as it provides for more control of the flow of fluid out of the container.

Referring to FIG. 4, an alternate embodiment of the container 10 is shown including a plurality of shaped pour guides 23–26 positioned about the circumference of the neck finish 16 of the container. The shaped pour guides 23–26 vary in configuration, in angle and distance from the neck finish 16, to provide the user with a selection of different guides for controlling and directing the flow of contents from the container. Similarly, referring to FIG. 5, the container 10 provided with a plurality of shaped pour guides 28–30 for providing a selection of pour guides for controlling and directing the flow of fluid out of the container. As shown, the angle of the shaped pour guides as well as its width can be varied considerably to provide a variety of options for the user depending on the particular application for which the container 10 is intended.

Although modifications and changes may be suggested by those skilled in the art, it is the intention of the inventor to embody within the patent warranted hereon all changes and modifications as reasonably and properly come within the scope of his contribution to the art.

What is claimed is:

1. A container for holding and pouring semi-viscous or viscous liquids comprising:

an integrally molded body defining an interior chamber and having a bottom wall, a side wall, and a neck;

a neck finish formed by said neck and defining a generally cylindrical opening to said chamber;

said neck finish being adapted to secure a lid to said container in order to seal said opening and said chamber:

at least one shaped pour guide formed by said body below said neck finish and including first and second projections extending radially inwardly beyond said neck finish and defining a profiled shape therebetween, including a plurality of said shaped pour guides formed by said neck and spaced about a circumference of said neck finish; and said plurality of shaped pour guides including a first set of three shaped pour guides having three equidistantly spaced profiled shapes being generally positioned axially under said neck finish.

2. The container of claim 1 in which each of said projections of each of said shaped pour guides has an interior edge that is substantially linear and extends between adjacent profiled shapes of said shaped pour guides.

3. The container of claim 1 in which each of said projections includes a top face and a bottom face that extend generally transverse to said body and beyond said neck finish into said opening.

4. The container of claim 3 in which said plurality of shaped pour guides further includes a second set of three shaped pour guides having three equidistantly spaced profiled shapes being generally positioned radially inwardly beyond said neck finish.

5. The container of claim 4 in which each of said first and second sets of shaped pour guides form an angle leading to said profiled shape greater than 90°.

6. The container of claim 5 in which said angle of said first set of shaped pour guides is less than said angle of said second set of shaped pour guides.

7. The container of claim 6 in which said angle of said first set of shaped pour guides is about 90' and said angle of said second set of three shaped pour guides is about 150'.

8. A container for holding and pouring semi-viscous or viscous liquids comprising:

an integrally molded body defining an interior chamber and having a bottom wall, a side wall, and a neck;

a neck finish formed by said neck and defining a generally cylindrical opening to said chamber;

said neck finish being adapted to secure a lid to said container in order to seal said opening and said chamber;

at least one shaped pour guide formed by said body below said neck finish and including first and second projections extending radially inwardly beyond said neck finish and defining a profiled shape therebetween, in which each of said projections has a generally U-shaped cross section defining a hollow U-shaped space between said top and bottom surfaces of an exterior of said body; and four of said shaped guides having four profiled shapes being generally positioned axially under said neck finish and being equidistantly spaced about a circumference of said neck finish.

9. The container of claim 1 in which said profiled shape of said shaped pour guide is positioned axially under said neck finish.

10. The container of claim 1 in which said wide-mouth opening has a diameter of about 1 to 5 inches and said interior chamber has a capacity of about 32 to 640 ounces.

* * * * *